United States Patent [19]

Lane

[11] Patent Number: 4,985,131

[45] Date of Patent: Jan. 15, 1991

[54] PROCESS FOR TREATING OIL SLUDGE

[75] Inventor: George M. Lane, New Orleans, La.

[73] Assignee: Thermal Waste Management, New Orleans, La.

[21] Appl. No.: 440,471

[22] Filed: Nov. 21, 1989

Related U.S. Application Data

[63] Continuation of Ser. No. 213,721, Jun. 30, 1988, abandoned.

[51] Int. Cl.[5] ..... C10G 17/00

[52] U.S. Cl. ..... 208/13; 201/25; 210/609; 585/240

[58] Field of Search ..... 208/13, 179, 184, 186; 44/24; 201/25, 44, 3; 210/609; 585/240

[56] References Cited

U.S. PATENT DOCUMENTS

| | | | |
|---|---|---|---|
| 1,618,563 | 2/1927 | Bascov | 44/24 |
| 1,951,739 | 3/1934 | Rodman et al. | 208/186 |
| 2,043,646 | 6/1936 | Bahlke | 208/13 |
| 2,774,716 | 12/1956 | Kulik | 44/24 |
| 3,652,405 | 3/1972 | Hess et al. | 210/608 |
| 3,692,668 | 9/1972 | McCoy et al. | 208/13 |
| 3,696,021 | 10/1972 | Cole et al. | 208/13 |
| 3,716,474 | 2/1973 | Hess et al. | 208/13 |
| 3,791,965 | 2/1974 | Fitzsimon et al. | 208/184 |
| 4,014,780 | 3/1977 | McCoy | 208/13 |
| 4,097,378 | 6/1978 | St. Clair | 208/13 |
| 4,135,888 | 1/1979 | Waltrip | 44/15 R |
| 4,260,489 | 4/1981 | Greig et al. | 208/13 |
| 4,366,049 | 12/1982 | Knorre et al. | 208/184 |
| 4,417,976 | 11/1983 | Sander et al. | 208/13 |
| 4,490,245 | 12/1984 | Mead et al. | 208/184 |
| 4,512,878 | 4/1985 | Reid et al. | 208/184 |
| 4,596,584 | 6/1986 | Darby | 44/24 |
| 4,618,735 | 10/1986 | Bridle et al. | 208/13 |
| 4,666,585 | 5/1987 | Figgins et al. | 208/131 |

FOREIGN PATENT DOCUMENTS

| | | | |
|---|---|---|---|
| 0224353 | 3/1987 | European Pat. Off. | 208/13 |
| 0285231 | 5/1988 | European Pat. Off. | 208/13 |

OTHER PUBLICATIONS

"Evaluation or Treatment Technologies for Listed Petroleum Refinery Wastes", American Petroleum Institute, Jun. 1987.

*Primary Examiner*—Anthony McFarlane
*Attorney, Agent, or Firm*—Finnegan, Henderson, Farabow, Garrett & Dunner

[57] ABSTRACT

A process for treating pretroleum refinery sludge to produce a coke-like residue product wherein an oily petroleum refinery sludge containing organic solid material boiling above 1000° F. and water is heated to a temperature above the boiling point of water and below the thermal cracking temperature of hydrocarbons and water in the sludge forms steam used to steam strip any light hydrocarbons from the organic solid material which is recovered as a solid coke-like residue product.

9 Claims, 1 Drawing Sheet

PROCESS FOR TREATING OIL SLUDGE

This application is a continuation of application Ser. No. 213,721, filed June 30, 1988, now abandoned.

FIELD OF THE INVENTION

This invention relates to the treatment of petroleum refinery sludges, and particularly to a process for the treatment of such sludges to produce a coke-like product useful as a petroleum coke.

BACKGROUND OF THE INVENTION

In petroleum refinery operations, oily sludges are produced as a waste product. Such sludges are generally characterized as three-phase, multi-component, organic sludges containing water, oil, and solids. The oil component is typically one or more liquid hydrocarbon fractions of petroleum ranging from gasoline components to heavy oils. The solids component may comprise high boiling organic materials, or carbonaceous solids, and may contain metallic and other inorganic materials. The water is present as a result of the use of water for process cooling, cleaning, or the like. Because of the presence of hazardous materials in such sludges, their disposal presents a problem for the petroleum refiner.

Various methods have been proposed for disposing of oil sludges, but to date none have proven to be entirely satisfactory. One such proposed method involves incineration, but this presents environmental problems, the processing cost is very high, and time and money is required to obtain the necessary permits to operate the process. Another disposal technique is land disposal, involving land fill and surface impoundment.

As pointed out in the paper "Evaluation of Treatment Technologies for Petroleum Refinery Hazardous Wastes" presented at the conference on Performance and Costs of Alternatives to Land Disposal of Hazardous Waste, sponsored by the Air Pollution Control Association on Dec. 8-12, 1986, The Hazardous and Solid Waste Amendments of 1984 (HSWA) state that reliance on land disposal should be minimized or eliminated, and land disposal, particularly land fill and surface impoundment, should be the least favorite method of managing hazardous wastes. Five types of petroleum refinery sludges are identified as being hazardous. These are:

1. Dissolved air flotation (DAF)
2. Slop oil emulsion solids
3. Heat exchange bundle cleaning sludge
4. API separator sludge
5. Tank bottoms (leaded)

Such sludges are considered hazardous because of the presence of metals such as lead and chromium, or organic materials such as benzene, cresols, phenol and the like. As an alternative to land disposal methods, various alternative technologies have been proposed. These include solvent extraction, mechanical dewatering, thermal treatment, chemical fixation and stabilization (mixing the oily sludge with a solidifying agent such as cement). There is, however, a continuing search for a technique of disposing of refinery sludges which both meets environmental regulations and is economic to install and operate.

The United States Environmental Protection Agency, by its 1984 Coke Exemption, has exempted from its standards for fuels to which hazardous wastes have been added petroleum refinery wastes containing oil, provided such wastes are converted into petroleum coke at the same facility at which those wastes were generated, unless the resulting coke product exceeds one or more hazardous waste characteristics.

Due to the severe restriction by the HSWA amendments on land disposal techniques of hazardous waste, various other disposal methods have been proposed. For example, U.S. Pat. No. 3,917,564 discloses a processing technique wherein refinery sludges are used as a quench medium in a delayed coking process wherein the sludge is converted into petroleum coke at a pressure and temperature which cause the hydrocarbons in the sludge to crack and/or polymerize to form coke. While this latter technique may be sometimes satisfactory, not all petroleum refineries include a delayed coker. Further, if the sludge is, for example, very high in undesirable metals and ash, the resulting coke product may not be satisfactory for use as coke.

Thus, while there have been various methods proposed for disposing of petroleum refinery sludges, there is still a need for a simple and inexpensive process to convert such sludges to a coke-like product which is useable as a non-hazardous, non-regulated fuel.

It is also known to distill hydrocarbons from contaminated oil to leave a residue. For example, U.S. Pat. No. 4,101,414 discloses a process wherein used lubricating oil is predistilled in a steam-stripping still and the predistilled used oil is then subjected to vacuum distillation at a temperature below the cracking temperature of the oil to effect a separation of the used lubricating oil from a residue concentrate byproduct of heavy lube oil hydrocarbons and additives. The concentrate product formed during the vacuum distillation step includes heavy lube hydrocarbons, additives, metals, metal compounds and the like and is stated to be useful as a lubrication grease.

It is an obJect of the present invention to provide a process for converting petroleum refinery sludges to a coke-like product which is free, or substantially free, from environmentally undesirable hydrocarbons, e.g. volatile organic compounds, such as benzene, toluene and xylene.

Another object of the invention is such a process which permits treatment of petroleum refinery sludges on-site and leaves non-hazardous waste.

A further object of the present invention is such a process which is simple in operation, does not require substantial and elaborate equipment for carrying out the process, which equipment may be portable, if desired.

An advantage of the present invention is that it does not require extraneous steam for processing and, additionally, a cooling medium, such as cooling water, is not required to cool the coke-like product produced by the process. A further advantage of the invention is that the resulting coke-like product, while meeting environmental requirements, has sufficient BTU content for it to qualify as a low grade petroleum coke, which has an energy value between about 3000 and 10,000 BTU/lb.

SUMMARY OF THE INVENTION

To achieve the objects and in accordance with the purpose of the invention as embodied and broadly described herein, there is provided a process for treating petroleum refinery sludge to produce a coke-like product which process comprises forming a feed stream of an oily petroleum refinery sludge containing organic solid material boiling above 1000° F. and a preselected amount of water; introducing said feed stream into a sludge drier; heating the feed stream in said drier to a temperature above the boiling point of water and below the temperature at which thermal cracking of hydrocarbons in the feed stream occurs; maintaining the heated feed stream in a non-oxidative atmosphere for a time sufficient for the water in the feed stream to form steam and for the steam to strip an light hydrocarbons from said solid material in the feed stream; separating a hydrocarbon/water vapor stream from said solid material; and recovering a solid, coke-like residue product.

A preferred embodiment of the invention includes the step of pre-treating the feed-stream prior to the heating step to adjust the water content to a level providing sufficient steam for stripping light hydrocarbons from the solids while minimizing the heat required to vaporize the water in the feed-stream.

It is also preferred to preheat the feed-stream, prior to introducing it to the sludge drier, using the hot flue gases generated in the combustion of fuel used to heat the sludge drier. Such hot flue gases may be used to produce steam for indirect heating of the feed-stream in equipment similar to that used as the sludge drier.

The accompanying drawings, which are incorporated in and constitute part of this specification, illustrate one embodiment of the invention, and, together with the description, serve to explain the principles of the invention.

DESCRIPTION OF THE PREFERRED EMBODIMENT

Figure 1:
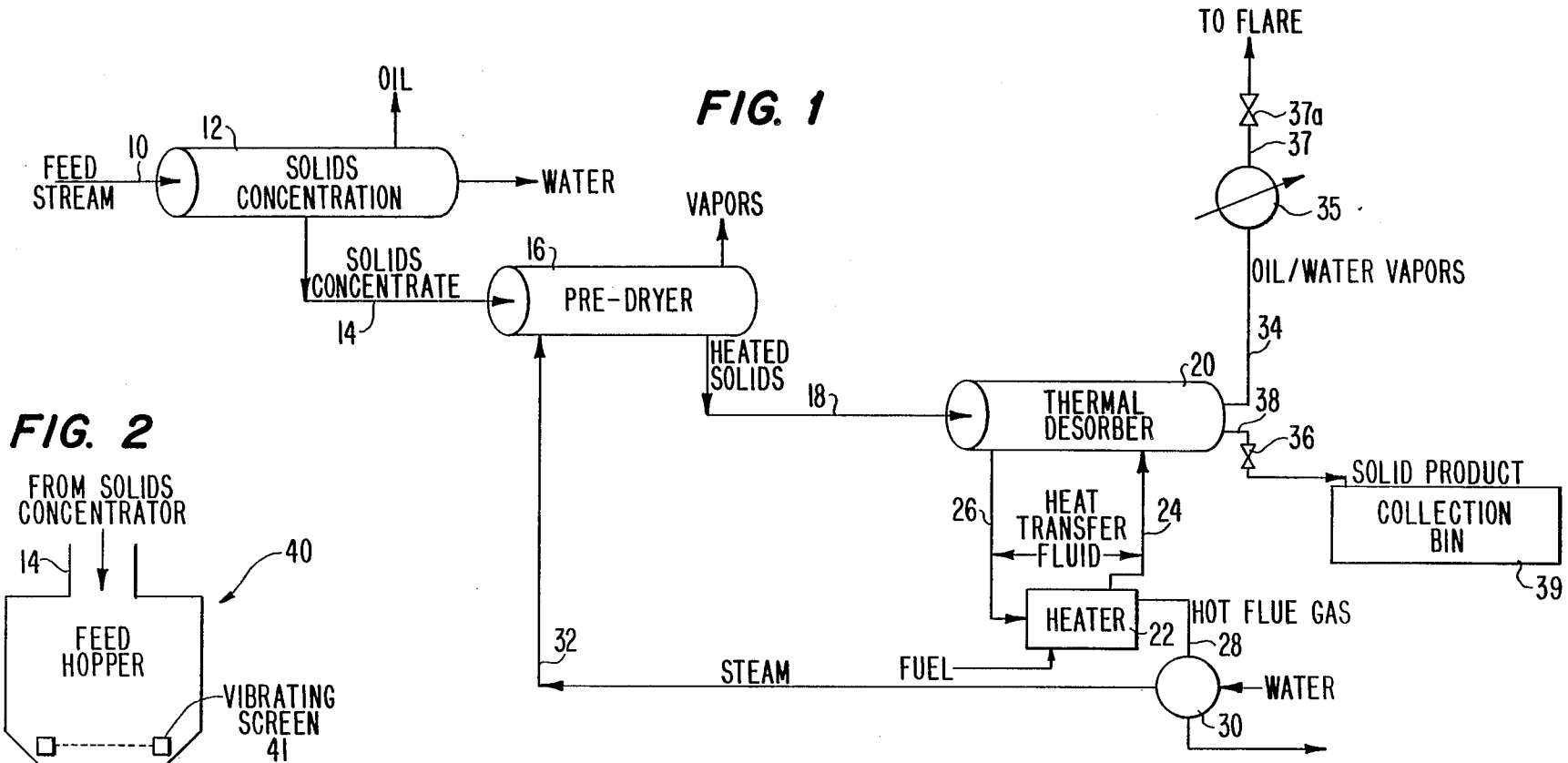
FIG. 1 is a schematic representation of the preferred equipment employed in the practice of the process of the present invention.
Figure 2:
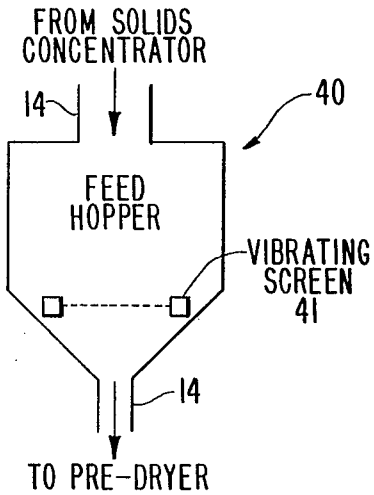
FIG. 2 is a schematic diagram of a feed hopper employed in the equipment of FIG. 1.

The feed-stream for the present process is one or more petroleum refinery sludges collected at the petroleum refinery at which the process is to be practiced. The petroleum refinery sludges, typically are three-phase, multi-component sludges, usually containing about 20–90 wt. % water, about 5–40 wt. % oil and about 5–35 wt. % solids. The oil portion may include volatile hydrocarbons such as various aliphatic, heterocyclic and aromatic compounds, as well as other organic compounds used or produced in the refinery operation. Such organic compounds may be, for example, organic acids, such as phenols and cresols. The solids portion of the sludge may include inorganic particulates, such as silica, alumina and the like, metals and metallic compounds, and high boiling organic compounds, e.g., those boiling above about 1000° F., which are normally solid in ambient temperatures. In the case where the solid residue product is to be burned to utilize its BTU content, the sludge should contain a sufficient amount of such high boiling organic solids to make it feasible to operate the process for this purpose. Preferably, the sludge does not contain large amounts of hazardous constituents such as lead, chromium, or the like.

It is usually preferred that the sludge does not contain significant amounts of light hydrocarbons, such as gasoline, naphtha, or kerosene, since they will not usually provide enough residual energy and they are quickly volatilized because of their low boiling points. Concentration of such light materials that will not recondense with typical cooling water at standard pressure may present an explosion hazard and, therefore, they are not desirable. Although crude petroleum is not preferred in the feed-stream when it contains a high concentration of non-condensable hydrocarbons, it may be included if appropriate equipment is provided.

The moisture content of the feed-stream is very important for the practice of the present process. The feed-stream should contain sufficient water to provide steam for adequately stripping light hydrocarbons and the like from the solids contained in the feed-stream. If, however, the feed-stream contains water in an amount greater than that required for the desired stripping, additional heat will be required to vaporize the water and this will reduce the predicted capacity of the equipment. For example, it was found that a sludge containing 15% water, 30% oil, and 55% solids could be processed at a predicted throughput of 6 tons per hour; however, another sludge containing 40% water, 9% oil and 51% solids could be processed at a capacity of only 3.84 tons per hour.

If the sludge to be treated has an inadequate moisture content, of course, water can be added to the sludge to adjust the water content of the feed-stream to a satisfactory level. Usually, however, it is desirable to reduce the water content of the sludge in order to form a satisfactory feed-stream for use in the process. Therefore, it is usually preferred to pretreat the sludge by dewatering it prior to introducing the feed-stream into the sludge drier, as hereinafter described. The sludge may be dewatered by the use of centrifuges, filter presses or the like. It may be desirable to use chemicals, such as demulsifiers and/or polymers, all of which may be used to reduce the heat demand and increase the throughput so as to reduce operating costs.

As shown in FIG. 1, a feed-stream 10 is formed from one or more of the petroleum refinery sludges described above and passed into a solids concentration unit 12 such as a filter press wherein oil and water are separated from the solids in the feed-stream to provide a solids concentrate having a water content between about 5% and about 25%, based upon the total weight of the pretreated sludge.

The solids concentrate is passed by way of line 14 to a pre-drier unit 16 which preferably is a screw flight drier of the type well known in the art. A screw flight drier is a hollow-screw jacketed-trough thermal drier wherein a solid material to be processed is moved through the drier by a rotating screw mechanism and a heat transfer fluid is circulated through the hollow screw and the jacket trough to heat the material passing through the drier. The pre-heated solids are passed by line 18 to a thermal desorber, or sludge drier 20, which also is preferrably a screw flight drier of the type described above. A suitable heat transfer fluid, such as Dowtherm, or another oil satisfactory for this purpose is heated to the desired temperature by heater 22 and circulated by a circulating pump (not shown) through thermal desorber 20 by lines 24 and 26. Typically, heater 22 is fired by a refinery fuel, for example, refinery gas, and the combustion thereof produces a hot flue gas which is passed via line 28 through heat exchanger 30 to vaporize water therein. The steam is then passed by line 32 to the predrier 16 and circulated therethrough as the heat medium to preheat the solids concentrate.

In sludge drier 20 the solids concentrate is heated to a temperature above the boiling point of water and maintained in a non-oxidative atmosphere. The residence time in sludge drier 20 should be long enough for the water contained in the solids concentrate to vaporize and permit the resulting steam to strip the remaining light hydrocarbons from the solids in the feed stream to leave a solid residue.

Vapors containing light hydrocarbons and water are removed from sludge drier 20 via line 34. The sludge drier 20 may be operated under a slight vacuum sufficient to draw off the vapors, or it may be operated under a slight pressure sufficient to force the vapors out of the system through line 34. These vapors are passed through a condenser 35 and the condensed water and hydrocarbons are collected and separated in an accumulator (not shown) and recovered. Non-condensable vapors exit through relief line 37 provided with a relief valve 37*a* and are routed to the refinery flare (not shown).

It is important that the feed-stream passed through sludge drier 20 is not heated to a temperature at which thermal cracking of hydrocarbons in the feed-stream occurs. First, this would tend to produce coke which has a tendency to foul the system. Secondly, at temperatures below the thermal cracking temperature no free radicals are formed, preventing any non-condensables from being formed. Additionally, processing below the thermal cracking temperature level, e.g., less than about 660° F., prevents the same free radicals from, in a secondary reaction, joining together to form larger molecules.

Advantageously, a rotary valve 36 of the type well known in the art is used in the line 38 connected to the solids discharge port of sludge drier 20. The valve 36 is divided into several segments so that solid material may be transported out of the vessel without a release of vapors to the atmosphere. As the valve rotates, it seals the following and leading vanes so that at no time is there an uninterrupted path for discharging vapors. The valve 36 is located far enough from the bottom of the sludge drier 20 to prevent liquids from leaving with the produced solid residue. An outlet port on the bottom of the discharge end of sludge drier 20 preferably is fitted with a fine mesh screen to permit the draining off of liquids that, for any reason, fail to be vaporized or converted to a solid. Such liquid can be recycled back to the inlet line 18 ahead of the feed-stream flowing into the sludge drier 20. The volume of any recycled liquids can be measured by any convenient means of liquid flow measurement. When flow is detected, the operator can be notified and the liquid can then be fed back to the feed line 18.

The solid residue exits the system after passing through valve 36 and is collected as it drops into a collection bin 39, a 20–25 cubic yard container having a closed top.

In a typical operation, based upon a solids content of feedstock ranging from 30 to 60 wt. % (of the feed-stream passed through line 18 to thermal desorber 20) and a throughput of from 3.84 to 6.0 tons per hour, from about 1.19 to about 3.744 tons per hour of the coke-like residue can be produced in a continuous operation.

It is preferred to use a feed hopper or bin, 40 located in line 14 ahead of the pre-drier 16 to provide a surge vessel providing a continuous feed-stream to the pre-drier 16. The de-watered material can be placed into a bin, ideally between about 5 and about 7 cubic yard capacity, by any well known conveying device, such as an articulated conveyor belt (not shown). The bin, or hopper, should be located so that material from the bin gravity feeds into the pre-drier 16, is then conveyed through the drier, and exits at the end away from the bin. Depending upon the conveyance properties of the feed material to the pre-drier 16, it may be necessary to attach a vibrating mechanism 41, typically similar to an oil field shaker screen, to prevent bridging and plugging of the feed hopper.

The heated solids exiting pre-drier 16 will typically be at a temperature about 100° F., but not usually above 212° F. Therefore, line 18 should be vapor tight from pre-drier 16 to the inlet of sludge drier 20 to prevent emission of hydrocarbon vapors to the atmosphere.

Thermocouples should be placed at the exit of both pre-drier 16 and sludge drier 20, as well as in the lines 24, 26 and 32, transporting the heat transfer fluids to the sludge drier 20 and pre-drier 16, respectively. This permits a record of the temperatures so that a continuous heat balance can be maintained.

The above described technique for the thermal processing of the petroleum refinery sludges at low temperature to produce a coke like product suitable for use as low grade petroleum coke provides a number of advantages relative to other known forms of disposing of such sludges. Among these advantages, the process is cheaper, particularly in a service mode, since the cost of a compressor to capture, liquify and contain produced non-condensables is eliminated. The equipment used in the practice of the process can be portable and does not require additional complicated and expensive equipment.

Another important advantage is that, since the process operates below the thermal cracking temperature, coking is avoided, preventing a fouling problem, usually caused by the feed stock being passed directly over a heated surface. As explained above, this prevents the formation of free radicals leading to the formation of coke deposits on the interior of the processing equipment and eliminates the need for breaker bars to scrape off accumulated hydrocarbons from the interior walls of the processing equipment. Also, expensive equipment for collecting and condensing gases is not required.

Having described a preferred embodiment of the present invention, variations and modifications thereof, falling within the spirit of the present invention, will become apparent to those skilled in the art and it is intended that the scope of the present invention be limited only by the appended claims.

What is claimed is:

1. A process for treating petroleum refinery sludge to produce a solid residue product which process comprises:

(a) forming a feed-stream of an oily petroleum refinery sludge containing organic solid material boiling about 1000° F. and water;

(b) pretreating said feed-stream to adjust the water content thereof to between about 5% and about 25%, based upon the total weight of the resulting pre-treated feed-stream;

(c) introducing the resulting pre-treated feed-stream into a thermal sludge drier wherein said pre-treated feed-stream is indirectly heated by a heat transfer medium;

(d) heating said pretreated feed-stream in said drier to a temperature above the boiling point of water and below the temperature at which thermal cracking of said feed-stream occurs;

(e) maintaining the heated feed-stream in a nonoxidative atmosphere in said sludge drier for a time sufficient for said water in said feed-stream to form steam and for said steam to strip any light hydrocarbons from the solid material in said feed-stream to form a solid residue;

(f) separating a hydrocarbon-water vapor stream from said solid material; and (g) recovering said solid material as a solid residue product having a BTU content between about 3000 and 10,000 BTU/lb.

2. The process of claim 1, wherein said feed-stream is API separator sludge, heat exchange bundle cleaning sludge, tank bottoms sludge, slop oil emulsion solids, dissolved air flotation float or any mixture thereof.

3. The process of claim 1 wherein said pre-treated feed-stream is introduced into and heated in a hollow-screw, jacketed-trough sludge drier.

4. The process of claim 1, wherein the solid material content of said pretreated feed-stream is from about 20% to about 75%, based upon the total weight of the pretreated feed stream.

5. The process of claim 1, wherein said pretreatment comprises passing said feed stream through a centrifuge, filter press or chemical treatment step effective to dewater said feed stream.

6. The process of claim 1, wherein said heat transfer medium is heated by the combustion of a hydrocarbon fuel, said feed stream is dewatered to adjust the water content thereof, the dewatered feed-stream is preheated in a hollow-screw, jacketed-trough thermal preheater, and hot flue gas generated by combustion of said hydrocarbon fuel is used to indirectly heat said dewatered feed-stream in said preheater.

7. The process of claim 1, further comprising preheating said pre-treated feed stream prior to introducing said pre-treated feed stream into said sludge drier.

8. The process of claim 5, wherein said pre-treatment comprises passing said feed stream through a centrifuge.

9. The process of claim 7, wherein said pre-treated feed stream is preheated with a heat medium heated with hot flue gas generated in the combustion of fuel used to heat said heat transfer medium, prior to introducing said pre-treated feed-stream into said sludge drier.

* * * * *